US005165119A

United States Patent [19]

Yamato

[11] Patent Number: 5,165,119

[45] Date of Patent: Nov. 24, 1992

[54] CHEMICAL SETTING RECEPTACLE FOR URINAL SCUPPER OR THE LIKE

[75] Inventor: Satoshi Yamato, Yokohama, Japan

[73] Assignee: Amenity Co., Ltd., Japan

[21] Appl. No.: 724,838

[22] Filed: Jul. 2, 1991

[30] Foreign Application Priority Data

Jul. 6, 1990 [JP] Japan ..... 2-72138[U]
Oct. 8, 1990 [JP] Japan ..... 2-105757[U]

[51] Int. Cl.[5] ..... E03D 13/00; E03D 9/02

[52] U.S. Cl. ..... 4/309; 4/222.1; 422/264; 422/266

[58] Field of Search ..... 4/309, 300.3, 222.1, 4/222; 422/255, 264, 266

[56] References Cited

U.S. PATENT DOCUMENTS

| | | | |
|---|---|---|---|
| 3,597,772 | 8/1971 | Leavitt | 4/222 |
| 4,038,227 | 7/1977 | Swanholm et al. | 523/126 |
| 4,103,367 | 8/1978 | Kaufer | 4/222 |
| 4,574,400 | 3/1986 | Annowsky | 4/309 |
| 4,574,403 | 3/1986 | Dintemann et al. | 4/309 |
| 4,774,730 | 10/1988 | Ho | 4/300.3 |

*Primary Examiner*—Henry J. Recla
*Assistant Examiner*—David J. Walezak
*Attorney, Agent, or Firm*—Ostrolenk, Faber, Gerb & Soffen

[57] ABSTRACT

The chemical setting receptacle comprises a receptacle body loading chemical and a lid covering the top opening of the receptacle body, wherein the lid is formed by connecting more than one vertical plate and a passage connected to a chemical loading section of the receptacle body is installed between the vertical plates. Urine and water hitting the ridge of the vertical plate separate and fall into the chemical loading section and also, urine and water entering the passage hit the side of the vertical plate and fall into the chemical loading section. Therefore, urine and water do not splash outward. The receptacle body and lid are made of decomposable plastic material containing an additive having a decomposition by microorganisms and sunlight characteristic. After the receptacle is used, the additive is naturally decomposed in a short time by activity of microorganisms and irradiation of sunlight, the plastic material collapses into a granular resin, and the receptacle loses its original form.

10 Claims, 2 Drawing Sheets

CHEMICAL SETTING RECEPTACLE FOR URINAL SCUPPER OR THE LIKE

BACKGROUND OF THE INVENTION

1. Field of the Invention

The present invention relates to a chemical receptacle to be set to a urinal scupper or top inflow port into which low-tank cleaning water is poured.

2. Prior Art

A spud (decorative dish) made of earthenware which is the same material as a urinal body is conventionally installed on the urinal scupper so that it will cover the scupper without interrupting the flow of urine and water. For the above urinal, urolith made of calcium phosphate and calcium carbonate contained in urine is easily collected on the scupper and in the drain pipe connected to the scupper. Resultingly, the urinal becomes dirty and a bad smell is emitted. Therefore, to remove urolith and prevent it from collecting, a ball- or disk-type solid chemical mainly consisting of sulfamic acid is placed on the above scupper. Also, a receptacle with the same shape as the spud containing the chemical is placed on the scupper instead of the spud.

A receptacle containing the chemical is also placed on the top inflow port (water receiving portion) of the low-tank connected to a closet in order to send the chemical into the low-tank by receiving cleaning water from a cleaning tube (J-shaped).

The inside bottom shape of the urinal is formed so that it will gently and continuously be curved to the scupper. However, when placing a receptacle containing the chemical on the scupper, the receptacle becomes protruded. Therefore, to pass urine, there is a problem that urine easily splashes because it hits the receptacle and the floor is wet by the splashed urine. Also for the receptacle placed on the water receiving portion of the low-tank, there is a problem that water splashes because it hits the receptacle and the floor is wet by the splashed water.

Meanwhile, because the above receptacle is made of non-decomposable plastic material such as propylene resin, there is also a problem that it remains non-decomposable for a long time after it is discarded and causes environmental pollution.

OUTLINE OF THE PRESENT INVENTION

Therefore, it is an object of the present invention to prevent the urinal and low-tank and floors around them from being wet by preventing urine and water from splashing due to the above receptacle containing the chemical without interrupting the flow of urine and water and the discharge of chemical. It is another object of the present invention to realize a receptacle which is easily decomposed after it is discarded.

The present invention is made by considering the above subjects, which comprises a receptacle body for loading the chemical and a lid for covering the top opening of the above receptacle body, wherein the lid is formed by connecting more than one vertical plate to settle the above subjects by providing a chemical setting receptacle for a urinal scupper or the like featuring that a passage connected to the chemical loading section is installed between the above vertical plates. The above receptacle body and lid also provide the chemical setting receptacle for a urinal scupper or the like made of decomposable plastic material containing an additive having a decomposition by microorganisms and sunlight characteristic.

For the present invention, urine and water reaching the lid enters portions between vertical plates or passages of the lid, or hit the ridge of the vertical plate and enter the passages.

Therefore, they do not splash outward from the lid top. Urine and water hitting the side of the vertical plate only falls downward. Thus, urine and water entering the passage do not come out and are led to the chemical loading side.

Also, because the receptacle is made of decomposable plastic material containing an additive having a decomposition by microorganisms and sunlight characteristic, the additive is decomposed in a short time by activity of microorganisms and irradiation of sunlight, the plastic material collapses into a granular resin, and the receptacle looses its original form.

PREFERRED EMBODIMENTS

Figure 1:
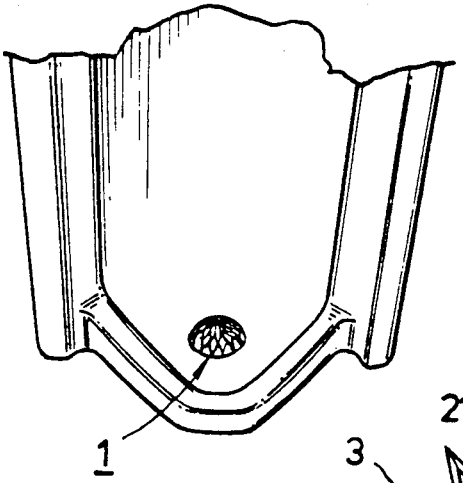
FIG. 1 shows the service condition of an embodiment of a chemical setting receptacle for a urinal scupper or the like of the present invention.

The following is the detailed description of the present invention according to the embodiments shown in FIGS. 1 through 6. In the drawings, numeral 1, as shown in FIG. 1, represents a chemical setting receptacle placed on the urinal scupper. The chemical setting receptacle comprises a receptacle body 2 having a chemical loading section 20 and a lid 3 which covers the top opening of the receptacle body 2 and on which a securing pawl 21 at the top of the receptacle body 20 is installed. Solid chemical "a" is loaded in the chemical loading section 20 of the receptacle body 2 and the chemical melts in urine and water flows through holes 22 at the side and bottom.

Figure 2:
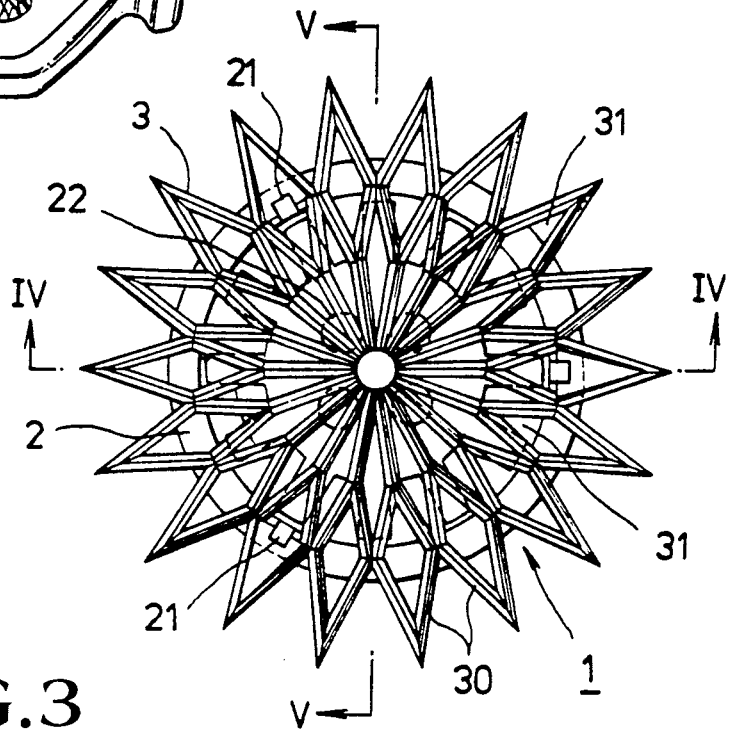
FIG. 2 shows a top view of the embodiment.
Figure 3:
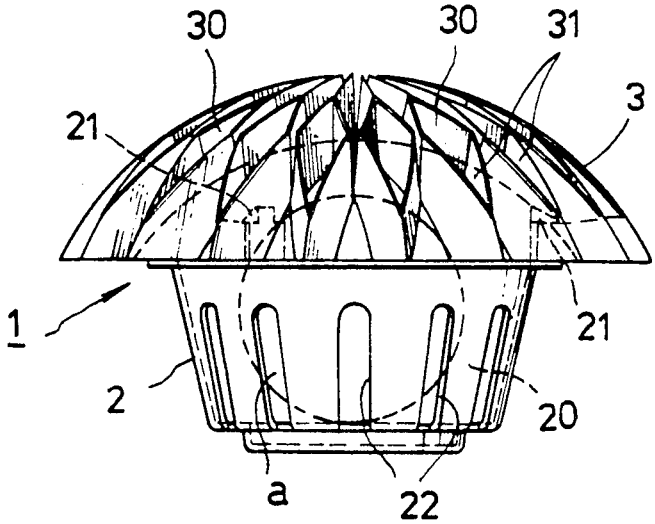
FIG. 3 shows a side view of the embodiment.
Figure 4:
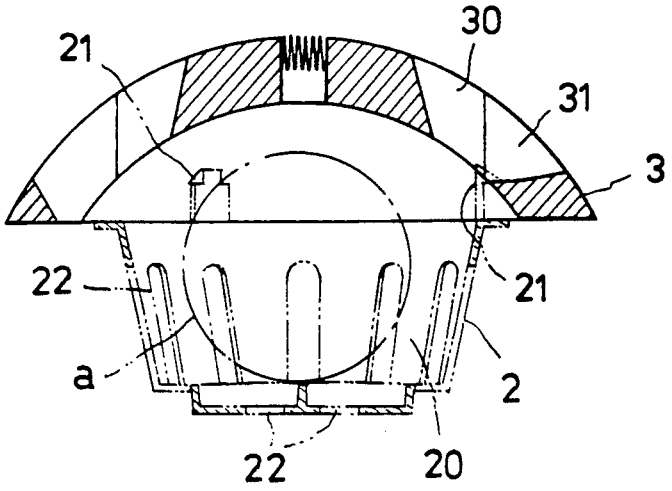
FIG. 4 shows a sectional view along the line IV—IV in FIG. 2.
Figure 5:
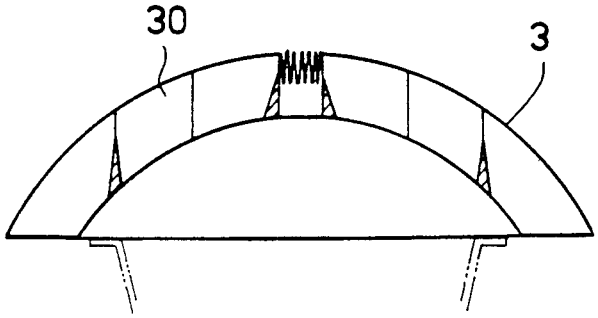
FIG. 5 is a sectional view along the line V—V in FIG. 2.

The lid 3, as shown in FIGS. 2 and 3, is formed like a dome by connecting more than one vertical plate 30. A passage 31 connected to the chemical loading section 20 is formed which is approximately rhombic viewed from the top (see FIGS. 4 and 5). The passage 31 is arranged so that it will be approximately radial around the lid 3.

Figure 6:
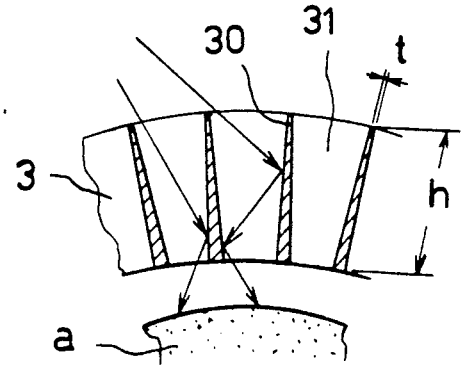
FIG. 6 shows the flow of urine and water.

Each of the vertical plates 30, as shown in FIG. 6, is installed so that the thickness "t" in the transverse sectional view of the plate will decrease at the ridge side. Urine and water hitting the vertical plate 30 separate to the right and left and fall into the chemical loading section 20. Therefore, they do not splash outward from the ridge section. Even if urine and water enter the passage 31 and hit the side of the vertical plate 30, they do not splash outward because they fall into the chemical loading section 20.

It is preferable that the bottom shape of the lid 3 corresponds to that of the solid chemical "a". When the solid chemical "a" is a ball as illustrated, urine and water passing through the lid 3 flow along the surface of the solid chemical "a" and smoothly flows through the holes 22 by making the bottom of the lid 3 concave and giving a certain interval between the surface of the solid chemical "a" and the bottom of the lid 3. The height "h" of the vertical plate should be 1.5 times or more of the passage width.

The above receptacle body 2 and lid 3 are made of decomposable plastic material containing an additive having a decomposition by microorganisms and sunlight characteristic. Therefore, after the receptacle 1 is used, it collapses into a granular resin and loses its original form because specially-treated starch additive is decomposed in a short time by activity of microorganisms and irradiation of sunlight.

For the above embodiment, the passages are approximately rhombic and radial. However, the present invention is not restricted to the above shape and layout. Various types of layouts and shapes (e.g. multi-contact cylindrical layout in which many grid-like, honeycomb-like, or cylindrical passages are adjacently arranged) can be selected.

As described above, for the present invention, the chemical loading receptacle comprises the receptacle body and the lid covering the top opening of the receptacle body, in which the lid is formed by connecting more than one vertical plate and the passage connected to the chemical loading section of the receptacle body is installed between the vertical plates. Therefore, urine and water hitting the ridge of the vertical plate fall into the chemical loading section and, also, urine and water entering the passage do not splash outward because they hit the side of the vertical plate and fall into the chemical loading section. Therefore, an excellent effect is shown because urine and water are prevented from splashing without interrupting the flow of water and urine.

By making the receptacle with the decomposable plastic material containing the additive having the decomposition by microorganisms and sunlight characteristic, the receptacle is naturally decomposed in a short time by activity of microorganisms and irradiation of sunlight after it is used, plastic material collapses into granular resin and the receptacle loses its original form. Moreover, the environment is not contaminated because the granular resin is not toxic for organisms.

I claim:

1. A chemical setting receptacle for a urinal scupper or the like, comprising a receptacle body for loading a chemical, said body having a top opening and a lid covering the top opening of said receptacle body, wherein said lid is formed by connecting more than one vertical plates and a passage connected to a chemical loading section of the receptacle body is installed between said vertical plates and wherein the thickness of the vertical plates decreases from a side facing the chemical loading section to the opposing side facing away from the chemical loading section.

2. A chemical setting receptacle for urinal scupper or the like according to claim 1, wherein said receptacle body and lid are made of decomposable plastic material containing an additive having a decomposition by microorganisms and sunlight characteristic.

3. A chemical setting receptacle for urinal scupper or the like according to claim 2, wherein the height of the vertical plates is at least 1.5 times the width of the passage installed between said plates.

4. A chemical setting receptacle for urinal scupper or the like according to claim 2, wherein the receptacle body has exit means for liquid in sides and a bottom thereof.

5. A chemical setting receptacle for urinal scupper or the like according to claim 4, wherein the shape of the side of the lid facing the chemical loading section corresponds to the shape of the chemical to be loaded in the chemical loading section.

6. A chemical setting receptacle for urinal scupper or the like according to claim 4, wherein the shape of the side of the lid facing the chemical loading section is concave.

7. A chemical setting receptacle for urinal scupper or the like according to claim 1, wherein a height of the vertical plates is at least 1.5 times the width of the passage installed between said plates.

8. A chemical setting receptacle for urinal scupper or the like according to claim 6, wherein the receptacle body has exit means for liquid in a sides and a bottom thereof.

9. A chemical setting receptacle for urinal scupper or the like according to claim 8, wherein the shape of the side of the lid facing the chemical loading section corresponds to the shape of the chemical to be loaded in the chemical loading section.

10. A chemical setting receptacle for urinal scupper or the like according to claim 9, wherein the shape of the side of the lid facing the chemical loading section is concave.

* * * * *

UNITED STATES PATENT AND TRADEMARK OFFICE

CERTIFICATE OF CORRECTION

PATENT NO. : 5,165,119

DATED : November 24, 1992

INVENTOR(S) : Satoshi Yamato

It is certified that error appears in the above-identified patent and that said Letters Patent is hereby corrected as shown below:

Column 1, line 45, for "posable" read --posed--.

Column 4, line 32, for "a" read --the--.
line 36, for "6" read --7--.

Signed and Sealed this

Seventh Day of June, 1994

*Attest:*

Bruce Lehman

BRUCE LEHMAN

*Attesting Officer*

*Commissioner of Patents and Trademarks*